US011707665B2

(12) United States Patent
Eckart

(10) Patent No.: US 11,707,665 B2
(45) Date of Patent: Jul. 25, 2023

(54) BRAKE ARRANGEMENT FOR A TOURING BINDING

(71) Applicant: Salewa Sport AG, Denges (CH)

(72) Inventor: Uwe Eckart, Aschheim (DE)

(73) Assignee: SALEWA SPORT AG, Denges (CH)

( * ) Notice: Subject to any disclaimer, the term of this patent is extended or adjusted under 35 U.S.C. 154(b) by 0 days.

(21) Appl. No.: 17/481,384

(22) Filed: Sep. 22, 2021

(65) Prior Publication Data

US 2022/0088466 A1 Mar. 24, 2022

(30) Foreign Application Priority Data

Sep. 23, 2020 (DE) ..... 10 2020 124 790.7

(51) Int. Cl.

| | |
|---|---|
| ***A63C 9/08*** | (2012.01) |
| ***A63C 9/00*** | (2012.01) |
| ***A63C 9/085*** | (2012.01) |
| ***A63C 9/086*** | (2012.01) |

(52) U.S. Cl.

CPC ..... *A63C 9/0807* (2013.01); *A63C 9/006* (2013.01); *A63C 9/086* (2013.01); *A63C 9/08528* (2013.01)

(58) Field of Classification Search

CPC ... A63C 9/0807; A63C 9/006; A63C 9/08528; A63C 9/086; A63C 7/1026; A63C 7/104

See application file for complete search history.

(56) References Cited

U.S. PATENT DOCUMENTS 3,933,361 A * 1/1976 Beyl ..... A63C 7/1033 280/605
4,101,145 A * 7/1978 Korger ..... A63C 7/104 280/605

(Continued)

FOREIGN PATENT DOCUMENTS

DE 102012208915 A1 * 11/2013 ..... A63C 7/005
DE 102012208915 A1 11/2013
DE 202013012328 U1 3/2016

(Continued)

OTHER PUBLICATIONS

German Application No. 10 2020 124 790.7, German Search Report dated Apr. 22, 2021, 6 pages.

*Primary Examiner* — James A Shriver, II
*Assistant Examiner* — Michael T. Walsh
(74) *Attorney, Agent, or Firm* — Kilpatrick Townsend & Stockton LLP

(57) ABSTRACT

A brake arrangement for a touring binding adjustable between a braking position and a sliding position, including: a base having a fastening arrangement; a pedal; at least one brake arm mounted on the base and on the pedal; at least one first resilient element to preload the brake arrangement into the braking position; a locking element that is linearly displaceable along a longitudinal direction of the ski to adjust between an active position, which locks the brake arrangement in the sliding position, and a passive position; and an actuating element mounted on the brake arrangement pivotable about a pivot access, the actuating element adjustable between a locking position, where the locking element is set into the locking position, and a release position, where the locking element is set into the passive position, and wherein a pivoting movement of the actuating element causes a linear movement of the locking element.

19 Claims, 4 Drawing Sheets

(56) References Cited

U.S. PATENT DOCUMENTS

| | | | | | |
|---|---|---|---|---|---|
| 4,544,177 | A * | 10/1985 | Svoboda | ..... | A63C 7/104<br>280/605 |
| 9,114,306 | B2 * | 8/2015 | Vailli | ..... | A63C 7/1033 |

FOREIGN PATENT DOCUMENTS

| | | | | | |
|---|---|---|---|---|---|
| DE | 202013012328 | U1 * | 5/2016 | ..... | A63C 7/102 |
| EP | 3476446 | B1 * | 4/2021 | ..... | A63C 7/1026 |
| WO | 2009105866 | A1 | 9/2009 | | |
| WO | WO-2009105866 | A1 * | 9/2009 | ..... | A63C 7/1013 |

* cited by examiner

BRAKE ARRANGEMENT FOR A TOURING BINDING

CROSS REFERENCE TO RELATED APPLICATION

This application claims priority to German Patent Application No. 10 2020 124 790.7, filed in Germany on Sep. 23, 2020, the entire contents of which are hereby incorporated herein by this reference.

The present invention relates to a brake arrangement for a touring binding, wherein the brake arrangement is adjustable between a braking position and a sliding position, comprising a base having a fastening arrangement for fastening to a ski and/or to the touring binding, a pedal which, on the side thereof facing away from the ski, has a step surface for a shoe, in particular for a heel portion of a ski boot, at least one brake arm which is mounted on the base and on the pedal, at least one first resilient element which is designed to preload the brake arrangement into the braking position, and a locking element which is adjustable between an active position and a passive position and, in the active position, is designed to lock the brake arrangement in the sliding position.

It is the object of a brake arrangement for ski and/or touring bindings to brake the ski in the event of a decoupling of the shoe and binding, for example in the event of a fall, also called triggering, or any other loss of the ski on sloping terrain, in order to prevent the loss of the ski and also to prevent danger for other winter sports enthusiasts posed by the moving ski. A brake arrangement therefore represents an important safety feature for a touring binding. If the binding is coupled to a shoe, said shoe presses the pedal downwards against the force of the resilient element and the brake arm(s) connected to the pedal are lifted in a vertical direction to a level above the ski surface, so that the brake arrangement is in a sliding position or moving position and the brake arms can no longer engage with the ground.

In particular in the case of touring bindings, which are used not only for downhill skiing but also for uphill skiing using what are known as climbing skins, which are fastened to the skiing surface, a locking or blocking of the brake arrangement in a sliding position or walking position is necessary, in which the brake arm(s) are lifted to a level in the vertical direction above the skiing surface even without the action of force by a shoe of a user on the pedal, so that the shoe, in particular a shoe heel, can be lifted from the brake arrangement for uphill skiing without the brake arm(s) engaging with the ground and braking the ski.

WO 2009/105866 A1 discloses a brake arrangement for a touring binding, which is arranged in front of a heel unit. For locking the brake arrangement, a hook is provided which is pivotable about a horizontal axis parallel to the ski surface and which can engage a brake pedal in order to block the brake arrangement in the sliding position or walking position. In order to allow for coupling and decoupling between the pedal and the hook, the entire heel unit is formed to be linearly displaceable in the longitudinal direction of the ski. In a walking position of the binding body, in which the heel unit is not coupled to a shoe, the binding body and the hook do not interact. The hook is preloaded into a substantially upright position and can come into engagement with the pedal to block the brake arrangement. A displacement of the binding body forwards in the direction of movement into a moving position of the binding body for coupling to a shoe heel causes the hook to be pivoted backwards. After pivoting the hook backwards by displacing the heel unit forwards, the hook can no longer engage with the pedal, the brake arrangement is no longer locked and the brake arms of the brake arrangement that are preloaded into a braking position can engage with the ground in order to brake the ski in the event of a fall, a triggering of the binding or any other loss of the ski.

In the case of ski bindings and in particular in the case of touring bindings, low weight and in particular a less complex structure play an extremely important role. For example, when used under adverse weather conditions and cold temperatures in ice and snow, a simple structure is of great advantage. In WO 2009/105866 A1, the heel unit is formed so as to be longitudinally displaceable for adjustment between a walking position and a sliding position. The locking of the brake arrangement is also achieved through this longitudinal displaceability. However, the fact that the entire heel unit is displaceable results in a relatively complicated structure with many, sometimes heavy components, and the stability of the entire arrangement can also be adversely affected.

Against this background, it is an object of the present invention to provide a brake arrangement for a touring binding with a brake locking function, which is particularly simple and has few components and at the same time has the lowest possible weight and high stability.

According to a first aspect, this object is achieved by a brake arrangement for a touring binding, wherein the brake arrangement is adjustable between a braking position and a sliding position, comprising a base having a fastening arrangement for fastening to a ski and/or to the touring binding, a pedal which, on the side thereof facing away from the ski, has a step surface for a shoe, in particular for a heel portion of a ski boot, at least one brake arm which is mounted on the base and on the pedal, at least one first resilient element which is designed to preload the brake arrangement into the braking position, and a locking element which is adjustable between an active position and a passive position and, in the active position, is designed to lock the brake arrangement in the sliding position, the locking element, for adjustment between the active position and the passive position, being linearly displaceable along a longitudinal direction of the ski, the brake arrangement further comprising an actuating element which is adjustable between a locking position and a release position, the actuating element being mounted on the brake arrangement, in particular on the base, so as to pivot about a pivot axis and, when the actuating element is set into the locking position, the locking element being set into the active position and, when the actuating element is set in the release position, the locking element being set into the passive position, the locking element and the actuating element being configured such that a pivoting movement of the actuating element about the pivot axis causes a linear movement of the locking element in the longitudinal direction of the ski.

An important feature of the invention is thus the conversion of a pivoting movement of the actuating element into a linear movement of the locking element. As a result, the brake arrangement can be locked in the sliding position without having to move or displace an associated touring binding or a heel unit of a touring binding.

In particular, two brake arms which are substantially symmetrical with respect to a longitudinal axis of the ski can be provided. The first resilient element can be, for example, a tension spring which is coupled to the pedal and the base such that a braking force is transmitted to the brake arm or the brake arms via the pedal, which forces down the ends of the brake arms in the vertical direction in order to engage with the ground in the braking position.

At this point it should be noted that, within the context of this disclosure, in order to simplify visualization, terms such as "top", "bottom", "front", "rear", "lateral", "vertical", "horizontal", "vertical direction", "width direction", "longitudinal direction" and the like relate to the point of view of a skier who has stepped into the front unit of a ski binding, in particular touring binding, mounted on a ski using a ski boot, the ski being arranged in a horizontal plane.

Furthermore, it should also be noted that the term "ski" as well as the terms containing this term, such as "ski boot", "ski binding", "touring ski binding", "ski plane", "longitudinal axis of the ski", "central axis of the ski", "width direction of the ski", "longitudinal direction of the ski" and the like, are not only to refer to skis in the narrower sense, but also comprise splitboards (snowboards that can be divided lengthways into at least two parts, the individual parts of which can be used in the manner of normal skis), snowshoes or similar boards for walking or sliding on snow and ice. All of these objects or parts thereof are regarded as skis or parts of skis for the purposes of this invention.

In a particularly preferred embodiment of the present invention, the brake arrangement can furthermore comprise at least one second resilient element which is designed to preload the locking element into the active position. By means of a second resilient element of this type, it can be achieved particularly easily that the locking element is preloaded into the active position. This means that without any, in particular manual, adjustment the locking element remains in the active position and thus the latching of the brake arrangement in the sliding position can take place in a simple manner.

The second resilient element can preferably provide a spring force for preloading the brake arrangement into the braking position. The spring action of the first resilient element can thus be supported by the second resilient element.

In particular, the second resilient element can be a tension spring which is coupled to the pedal and the locking element. It goes without saying that other springs coupled to the locking element, such as compression springs, leg springs, etc., can also be used for the preloading.

In a further preferred embodiment of the invention, the pedal can be pivotably mounted on the base, in particular a pivot axis of the pedal being guided so as to be longitudinally displaced in an elongate hole provided on the base. As a result, a latching of the brake arrangement can be achieved in a simple manner by longitudinally displacing the locking element.

In addition, the locking element can comprise a hook which is designed to engage the pedal in the active position of the locking element in order to block a movement of the pedal such that the brake arrangement is locked in the sliding position. A hook on the locking element can particularly easily engage the pedal in the active position of the locking element and block a movement of the pedal such that the brake arrangement is locked in the sliding position.

The locking element and the actuating element can particularly preferably be configured such that a pivoting movement of the actuating element from the release position into the locking position transfers the locking element into the active position. In particular, this can be done backwards in the longitudinal direction of the ski.

In addition, the locking element and the actuating element can be configured such that a pivoting movement of the actuating element from the locking position into the release position transfers the locking element into the passive position. In particular, this can be done forwards in the longitudinal direction of the ski. Although, as mentioned above, in this position of the actuating element, the locking element can already be set into the active position by the spring force of a possible second resilient element, but for example, due to icing of the mechanism or the like, the spring force of the second resilient element may not be sufficient to transfer the locking element into the passive and/or the active position, so that it is advantageous if the locking element is transferred from the locking position into the release position into the passive position by an adjustment movement of the actuating element.

In a further advantageous embodiment, in the release position of the actuating element, the actuating element can have a first contour which is designed to hold the locking element in the passive position. A contour of this type can in particular be in the form of a projection which can hold a counter-shaped projection or the like of the locking element such that the locking element remains in the release position.

In addition, in the locking position of the actuating element, the actuating element can have a second contour which is designed to hold the locking element in the active position. A contour of this type can in turn be in particular in the form of a projection which can hold a counter-shaped projection or the like of the locking element such that the locking element remains in the locking position.

In a further preferred embodiment, the actuating element can be an actuating lever which is pivotably mounted on the base and which comprises at least one lever arm pivotably mounted on the base and an actuating portion. In particular, the actuating lever can comprise two lever arms, the actuating portion connecting both arms. A lever of this type is particularly easy to operate.

The first contour can be formed on an insert element which is inserted into a recess on the lever arm, in particular on a first lever arm. An insert element of this type can in particular be formed from a metallic material, such as a sheet metal material or the like, whereby friction and the associated material wear do not apply directly to the lever, which is usually made of plastics material, but to an additional part, which is made of another, more wear-resistant material and/or is replaceable.

In addition, the second contour can be formed on an insert element which is inserted into a recess on the lever arm, in particular on a second lever arm. An insert element of this type can in turn be formed in particular from a metallic material, such as a sheet metal material or the like, whereby friction and the associated material wear do not apply directly to the lever, which is usually made of plastics material, but to an additional part, which is made of another, more wear-resistant material and/or is replaceable.

According to a second aspect, the above-defined object of the present invention is achieved by a heel unit for a touring binding, comprising a brake arrangement according to the first aspect of the present invention. The brake arrangement can thus be arranged, for example, directly in front of the heel unit in the direction of movement and the pedal of the brake arrangement can be held in the sliding position or moving position in a particularly simple manner by a shoe heel. Alternatively, an arrangement of the brake arrangement between the heel unit and a front unit or also an arrangement of the brake arrangement in front of a front unit is generally conceivable.

Particularly preferably, the heel unit and the actuating element can be configured such that, in the release position of the actuating element, a coupling of a shoe, in particular a heel portion of a ski boot, to the heel unit is possible and, in the locking position of the actuating element, a coupling of a shoe, in particular a heel portion of a ski boot, to the heel unit is not possible. In particular, this can be done in that a standing height on/above the pedal of the heel portion of the ski boot in the locked position is so high that the heel portion of the ski boot cannot engage the heel unit in order to be able to prevent incorrect operation in the locking position.

The invention is explained in more detail below on the basis of a preferred embodiment of the present invention with reference to the accompanying drawings. In the drawings.

Figure 1:
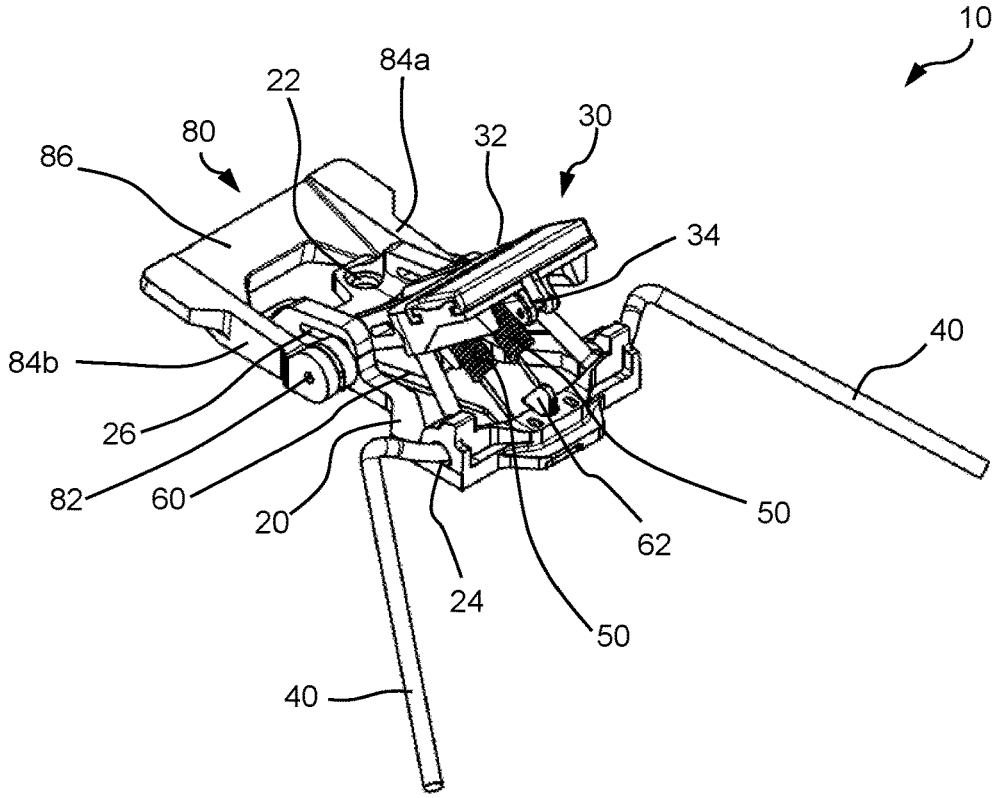
FIG. 1 is a perspective view of a brake arrangement according to the preferred embodiment of the present invention in a braking position.
Figure 2:
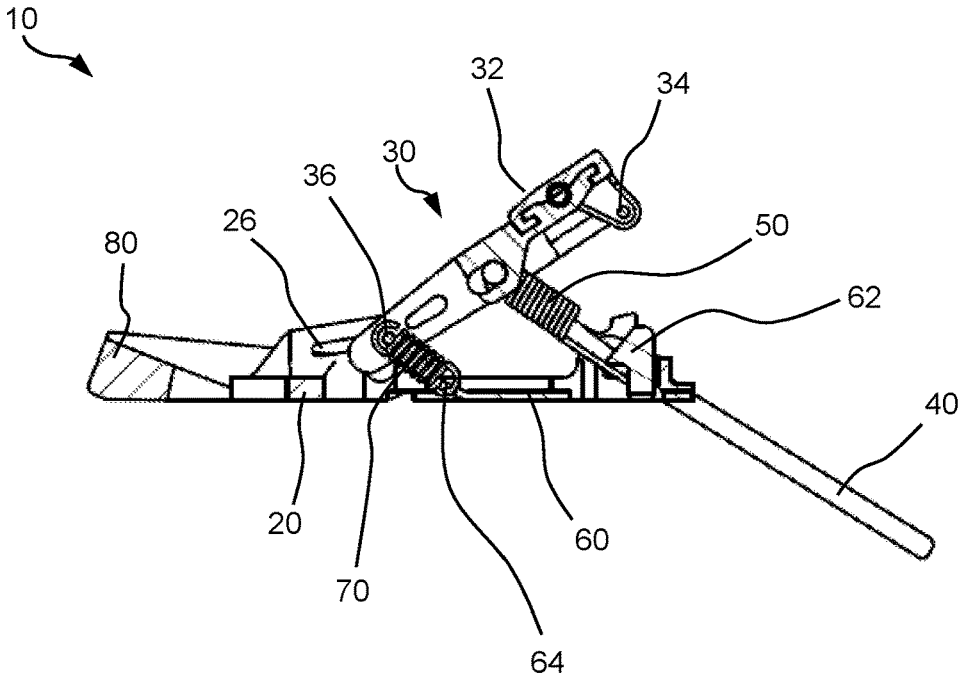
FIG. 2 is a sectional view of the brake arrangement according to the preferred embodiment of the present invention in the braking position.
Figure 3:
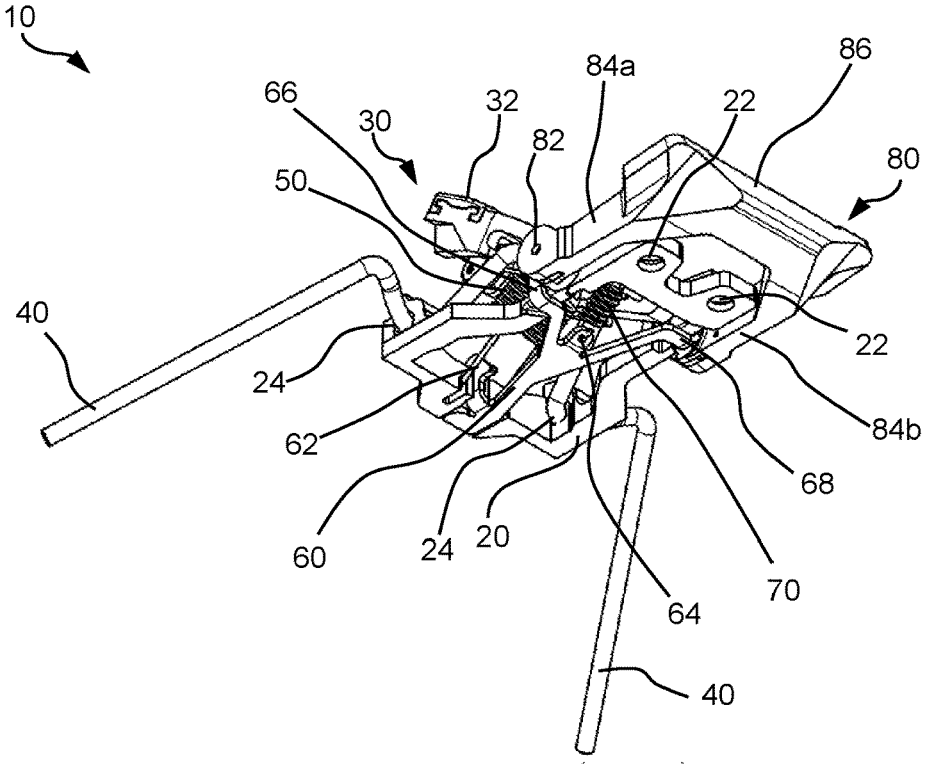
FIG. 3 is a further perspective view of the brake arrangement according to the preferred embodiment of the present invention in the braking position.
Figure 4:
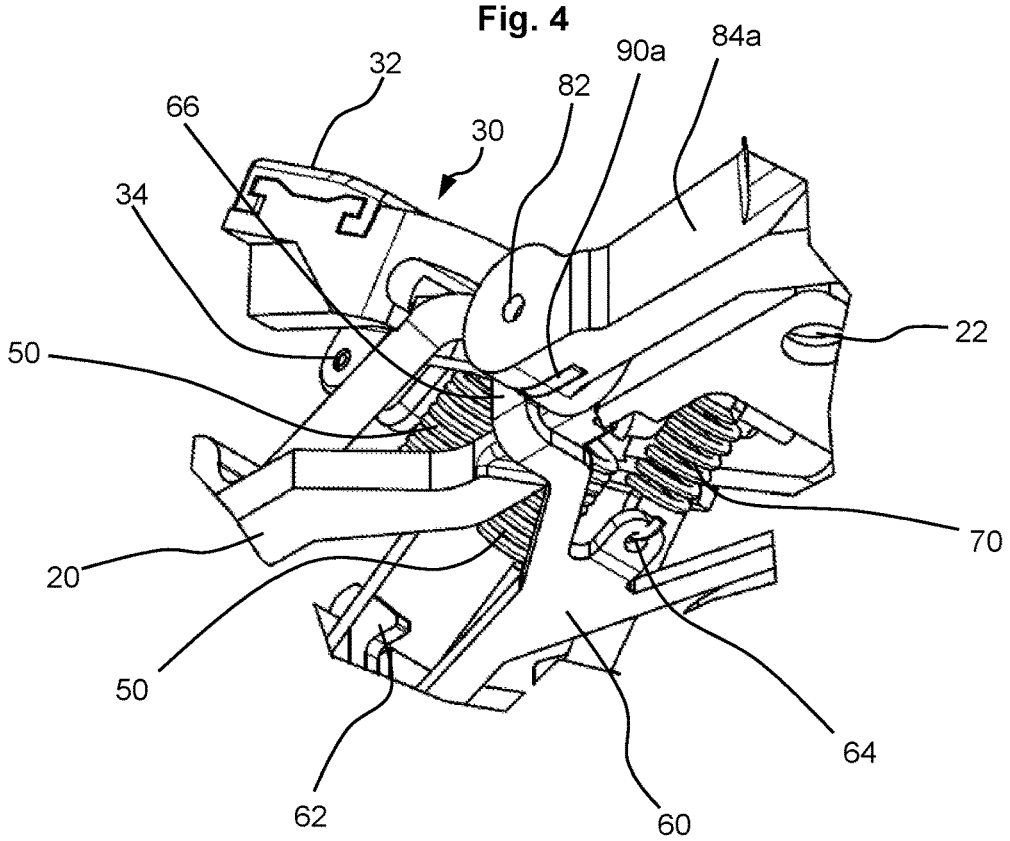
FIG. 4 is a detailed view of the brake arrangement from FIG. 3.

In FIGS. 1 to 9, a brake arrangement according to the invention in accordance with the preferred embodiment of the present invention is indicated overall by the reference sign 10. The brake arrangement 10 adjustable between a braking position and a sliding position is shown in the braking position in FIG. 1 to 4, in a transition position between the braking position and the sliding position in FIG. 5 and in the sliding position in FIG. 6 to 9.

The brake arrangement 10 comprises a base 20 having a fastening arrangement 22 for fastening to a ski (not shown) and/or to a touring binding (not shown), in particular to a heel unit of a touring binding, a pedal 30, at least one brake arm 40 mounted on the base 20 and on the pedal 30, in the present embodiment, two brake arms 40 arranged substantially symmetrically to a longitudinal axis of the ski, and at least one resilient element 50 which is designed to preload the brake arrangement 10 into the braking position shown in FIG. 1 to 4.

In the braking position, the brake arms 40 protrude in a horizontal width direction of the ski on the left side of the ski and on the right side of the ski, and end portions of the brake arms 40 project in a vertical direction past the ski downwards, in order to engage with the ground, in particular snow or ice. If only one brake arm 40 is provided, it protrudes either on the left side of the ski or on the right side of the ski. In the sliding position described further with reference to FIG. 6 to 9, the brake arms 40 are lifted in a vertical direction to a level above the ski surface, so that the brake arms 40, in particular exposed ends of the brake arms 40, can no longer engage with the ground. The first resilient element 50 can be, for example, a tension spring 50 which is coupled to the pedal 30 and the base 20 such that a braking force is transmitted to the brake arm 40 or the brake arms 40 via the pedal, which forces down the ends of the brake arms 40 in the vertical direction in order to engage with the ground in the braking position.

The brake arrangement 10 also comprises a locking element 60 which is adjustable between an active position and a passive position and, in the active position, is designed to lock the brake arrangement 10 in the sliding position, the locking element 60, for adjustment between the active position and the passive position, being linearly displaceable along a longitudinal direction of the ski. Furthermore, the brake arrangement 10 comprises an actuating element 80 which is adjustable between a locking position and a release position, the actuating element 80 being mounted on the brake arrangement 10, in the present embodiment on the base 20, so as to be pivotable about a pivot axis 82. When the actuating element 80 is set into the locking position, the locking element 60 is set into the active position. When the actuating element 80 is set into the release position, the locking element 60 is set into the passive position. The locking element 60 and the actuating element 80 are configured such that a pivoting movement of the actuating element 80 about the pivot axis 82 causes a linear movement of the locking element 60 in the longitudinal direction of the ski. A pivoting movement of the actuating element 80 is thus converted into a linear movement of the locking element 60, as a result of which the brake arrangement 10 can be locked in the sliding position.

In the present embodiment, a fastening or mounting of the base 20 to the ski can take place by placing a downward-facing support surface of the base 20 on an upward-facing surface of the ski, and the base 20 is fastened to the ski by means of screws which are guided through drill holes 22 provided in the base 20 and are screwed into the ski surface. As an alternative to a screw connection of the base 20 to the ski, the base 20 can also be fastened to the ski in a different way. As already mentioned above, it is also possible for the base 20 to be fastened to a touring binding (not shown), for example likewise by screws or by a plug connection, another form-fitting connection, by bolts, by gluing, or in some other way. Fastening to the ski and additionally to a touring binding is also possible. The base 20 can in particular be made of a metallic material, for example a sheet steel or aluminium, or a plastics material, such as polyoxymethylene (POM), glass fibre reinforced polyamide (PA), or another cold-resistant plastics material.

The pedal 30, on the side thereof facing away from the ski, has a step surface 32 for a shoe (not shown), in particular for a heel portion of a ski boot. If a user steps on the step surface 32 of the pedal 30 in order to couple his shoe to a touring binding, in particular to the heel unit of a touring binding, the brake arrangement 10 is moved from the braking position into the sliding position against the spring force of the resilient element 50. In this state, the sliding position is also referred to as the moving position. The sliding position or moving position is shown in FIG. 6 to 9. The pedal 30 can in particular be made of a plastics material, such as polyoxymethylene (POM), glass fibre reinforced polyamide (PA), or another cold-resistant plastics material. In the preferred embodiment, the pedal 30 can be pivotably mounted on the base 20 and comprise a pivot axis 36 which can protrude laterally from the pedal 30 and can be guided so as to be longitudinally displaced in elongate holes 26 provided on the base 20.

The brake arm(s) 40 can be mounted in a central part on a receptacle 24 formed on the base 20 and in a front portion on a receptacle formed on the pedal 30. The brake arm(s) 40 can in particular be made of a metallic material, such as steel, aluminium, titanium or various alloys.

In the present embodiment, two tension springs 50 can be provided. Each spring 50 may be provided with a rear bent end on a rear spring leg and a front bent end on a front spring leg and spring coils located therebetween. The rear bent end of the tension springs 50 can be fastened to the base 20 and the front bent end of the tension springs 50 can be fastened to the pedal 30. Thus, the resilient element 50 or the tension spring(s) 50 act(s) between the base 20 and the brake arm 40 via the pedal 30 and preload(s) the brake arrangement 10 into the braking position.

In the present embodiment, the brake arrangement 10 can furthermore comprise at least one second resilient element 70 which is designed to preload the locking element 60 into the active position. In the present embodiment, the second resilient element 70 can provide a spring force for preloading the brake arrangement 10 into the braking position, as a result of which the spring action of the first resilient element 50 can be supported by the second resilient element 70. In particular, the second resilient element 70 can be a tension spring 70 which is coupled to the pedal 30 and to the locking element 60. As can be seen, for example, in FIG. 2, the tension spring 70 can be fastened to the pedal 30 at one end. In particular, the pivot axis 36 can be provided on the pedal 30, on which pivot axis one end of the spring 70 can be suspended. At an opposite end, the tension spring 70 can be fastened to the locking element. In particular, a tab 64 can be provided on the locking element 60, on which tab the opposite spring end can be suspended. As a result, the tension spring 70 acts between the pedal 30 and the locking element 60, preloads the locking element 60 into the active position and, at the same time, provides a spring force for preloading the brake arrangement 10 into the braking position.

The locking element 60 can comprise a hook 62 which is designed to engage the pedal 30 in the active position of the locking element 60 in order to block a movement of the pedal 30 such that the brake arrangement 10 is locked in the sliding position. As can be seen for example in FIG. 2, a pin 34 can be formed on the pedal 30 in the preferred embodiment. Which can engage with the hook 62 of the locking element 60. As can be seen, the hook 62 and the pin 34 are disengaged in the braking position shown in FIG. 1 to 4.

Figure 5:
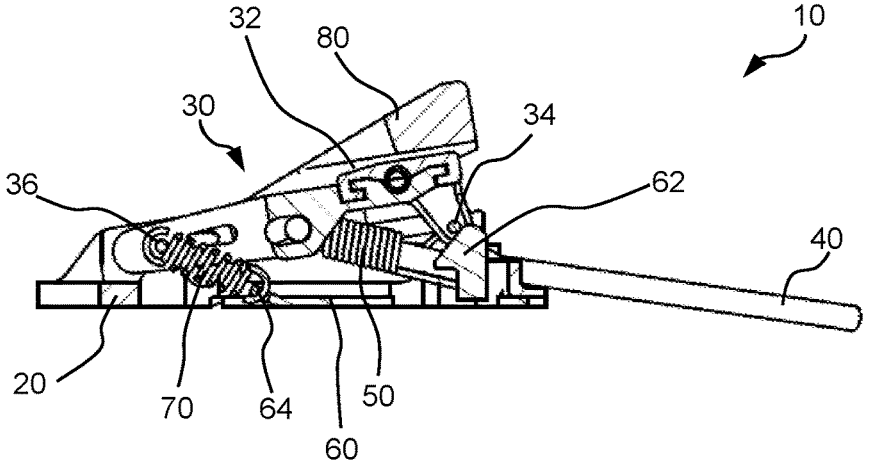
FIG. 5 is a sectional view of the brake arrangement according to the preferred embodiment of the present invention in a transition position between the braking position and a sliding position.
Figure 6:
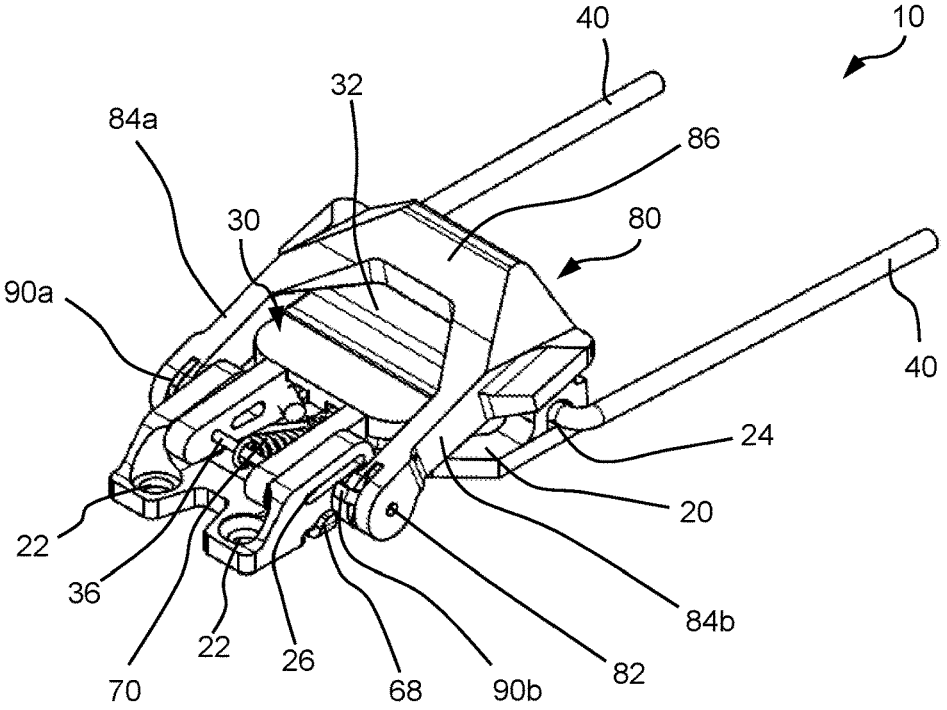
FIG. 6 is a perspective view of the brake arrangement according to the preferred embodiment of the present invention in the sliding position.
Figure 7:
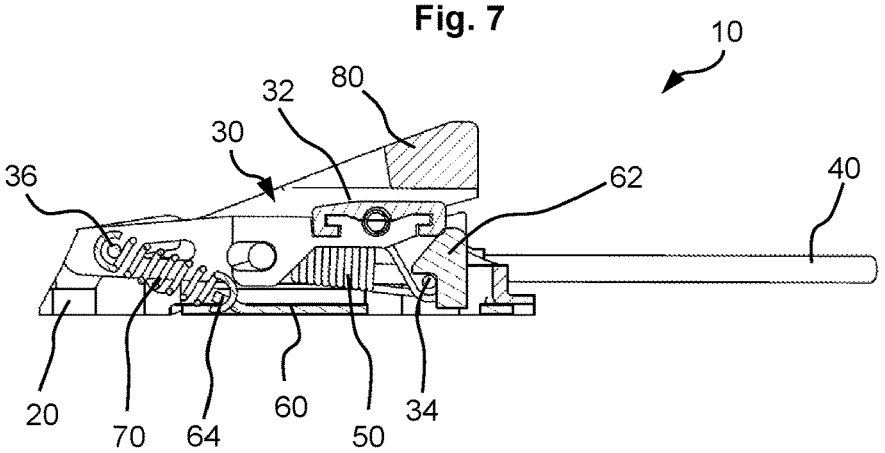
FIG. 7 is a sectional view of the brake arrangement according to the preferred embodiment of the present invention in the sliding position.
Figure 8:
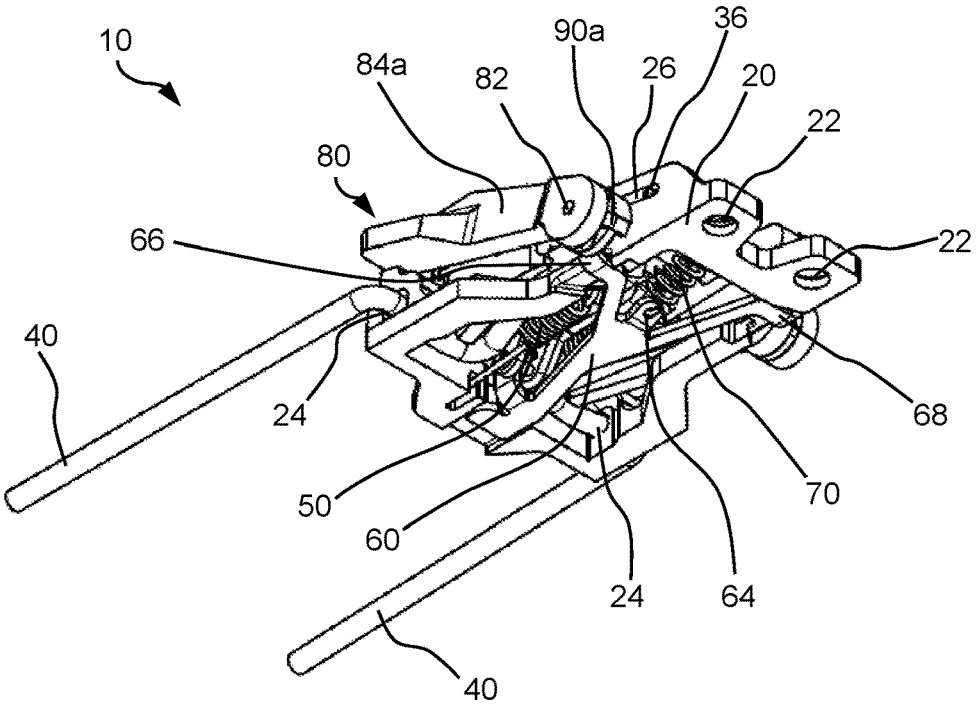
FIG. 8 is a further perspective view of the brake arrangement according to the preferred embodiment of the present invention in the sliding position.
Figure 9:
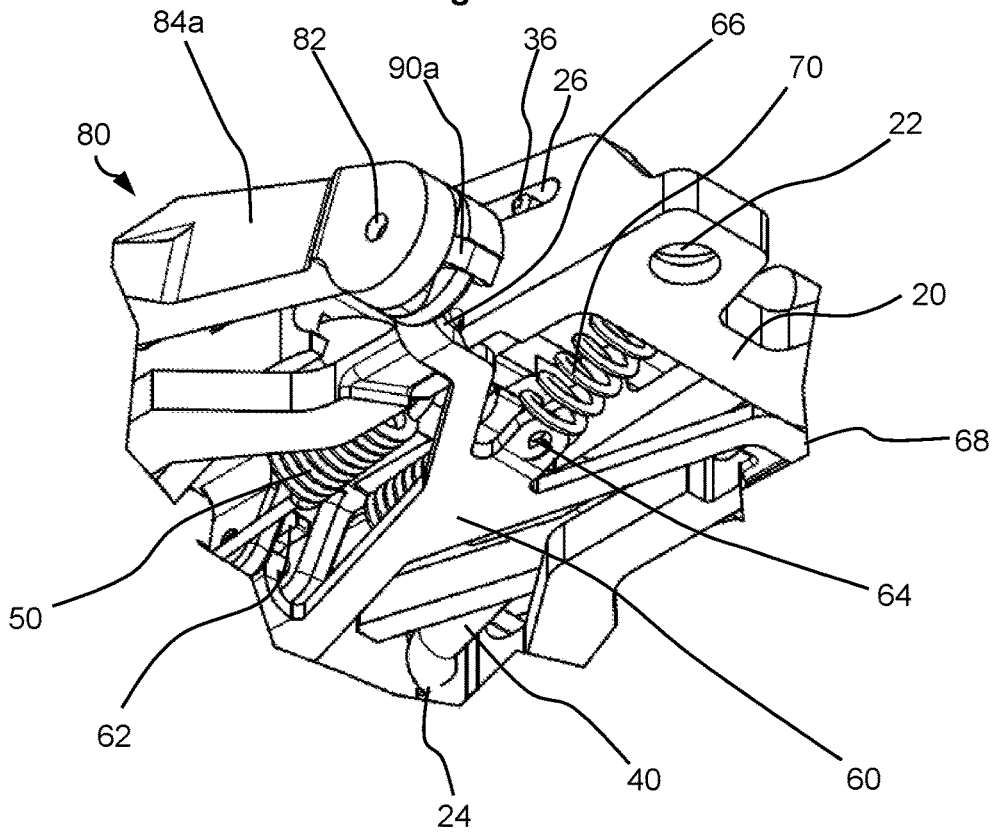
FIG. 9 is a detailed view of the brake arrangement from FIG. 8.

FIG. 5 is a sectional view of the brake arrangement 10 according to the preferred embodiment of the present invention in the transition position between the braking position and a sliding position. If a user steps on the step surface 32 of the pedal 30 in order to couple his shoe to a touring binding and to adjust the brake arrangement 10 from the braking position to the sliding position, the pin 34 hits an inclined surface of the hook 62. The pedal 30 can move forwards along the elongated holes 26 against the spring force of the spring 70 in the longitudinal direction of the ski, while the locking element 60 can also move backwards in the longitudinal direction of the ski against the spring force of the spring 70. As a result, the pin 34, as shown for example in FIG. 7, can snap into a recess in the hook 62 and the brake arrangement 10 is set into the sliding position, which is shown in FIG. 6 to 9.

In the preferred embodiment, the locking element 60 and the actuating element 80 can be configured such that a pivoting movement of the actuating element 80 from the release position into the locking position transfers the locking element 60 into the active position. In particular, this can be done backwards in the longitudinal direction of the ski. In addition, the locking element 60 and the actuating element 80 can be configured such that a pivoting movement of the actuating element 80 from the locking position into the release position transfers the locking element 60 into the passive position. In particular, this can be done forwards in the longitudinal direction of the ski. In this position of the actuating element 80, the locking element 60 has already been set into the active position by the spring force of the second resilient element 70; however, if the spring force of the second resilient element 70 is not sufficient to transfer the locking element into the passive and/or the active position, it is advantageous if the locking element 60 is transferred from the locking position into the release position into the passive position and vice versa by an adjustment movement of the actuating element 80.

For this purpose, in the release position of the actuating element 80, the actuating element 80 can have a first contour which is designed to hold the locking element 60 in the passive position. In the present embodiment, a contour of this type can in particular be in the form of a projection 90*a*, which can hold a counter-shaped projection 66 or the like of the locking element 60 such that the locking element 60 remains in the release position. In addition, in the locking position of the actuating element 80, the actuating element can have a second contour which is designed to hold the locking element 60 in the active position. A contour of this type can in turn be in particular in the form of a projection 90*b*, which can hold a counter-shaped projection 68 or the like of the locking element 60 such that the locking element 60 remains in the locking position. The actuating element 80 can be an actuating lever 80 which is pivotably mounted on the base 20 and which comprises at least one lever arm 84*a*, 84*b* pivotably mounted on the base 20 and an actuating portion 86. In particular, the actuating lever 80 can comprise two lever arms 84*a*, 84*b*, the actuating portion 86 connecting both arms 84*a*, 84*b*. For example, lateral wing-like portions can be provided on the actuating portion 86 in order to facilitate operation of the actuating portion 86.

The first contour can be formed on an insert element 90*a* which is inserted into a recess on the lever arm 84*a*, in particular on a first lever arm 84*a*. In addition, the second contour can be formed on an insert element 90*b* which is inserted into a recess on the lever arm 84*b*, in particular on a second lever arm 84*b*.

In the preferred embodiment, the projections 90*a* and 90*b* can each be formed on an arm 84*a* or 84*b* of the actuating element 80 designed as a lever 80, which arm is mounted on the pivot axis 82. In particular, slot-like recesses can be provided at the ends of the lever arms 84*a* and 84*b*, into which sheet metal inserts 90*a*, 90*b* are inserted, on which in turn the first and second contours could be provided in the form of the projections for holding the locking element 60 in the passive and active positions. The counter-formed projections 66 and 68 formed on the locking element 60 can be provided, for example, in that the locking element 60 is designed as a bent sheet metal part and is bent at corresponding points such that projections 66 and 68 are formed which can interact with the projections 90*a* and 90*b* on the lever arms 84*a* and 84*b*.

In this way, the first projection 90*a* formed on the first lever arm 84*a*, in particular in the form of a sheet metal insert, can interact with the projection 66 formed on the locking element 60 such that, in the release position of the actuating lever 80, the locking element 60 is held in the passive position. Conversely, the second projection 90*b* formed on the second lever arm 84*b*, in particular also in the form of a sheet metal insert, can interact with the projection 68 formed on the locking element 60 such that, in the locking position of the actuating lever 80, the locking element 60 is held in the active position.

The invention claimed is:

1. A brake arrangement for a touring binding, wherein the brake arrangement is adjustable between a braking position and a sliding position, the brake arrangement comprising:

a base having a fastening arrangement for fastening to one or more of a ski or the touring binding;

a pedal comprising a step surface for a shoe on a side of the pedal facing away from the ski;

at least one brake arm mounted on the base and on the pedal;

at least one first resilient element to preload the brake arrangement into the braking position;

a locking element, wherein the locking element is adjustable between an active position and a passive position and, when in the active position, locks the brake arrangement in the sliding position, wherein the locking element is linearly displaceable along a longitudinal direction of the ski for adjustment between the active position and the passive position; and an actuating element including a first contour, wherein the actuating element is adjustable between a locking position and a release position, wherein the actuating element is mounted on the brake arrangement, so as to pivot about a pivot axis and, wherein:

when the actuating element is set into the locking position, the locking element is set into the active position, and when the actuating element is set in the release position, the locking element is set into the passive position and is held in the passive position by the first contour, and a pivoting movement of the actuating element about the pivot axis causes a linear movement of the locking element in the longitudinal direction of the ski.

2. The brake arrangement of claim 1, further comprising at least one second resilient element to preload the locking element into the active position.

3. The brake arrangement of claim 2, wherein the second resilient element provides a spring force for preloading the brake arrangement into the braking position.

4. The brake arrangement of claim 3, wherein the second resilient element is a tension spring coupled to the pedal and the locking element.

5. The brake arrangement of claim 1, wherein the pedal is pivotably mounted on the base.

6. The brake arrangement of claim 1, wherein the locking element comprises a hook to engage the pedal in the active position of the locking element to block a movement of the pedal such that the brake arrangement is locked in the sliding position.

7. The brake arrangement of claim 1, wherein the locking element and the actuating element are configured such that a pivoting movement of the actuating element from the release position into the locking position transfers the locking element into the active position.

8. The brake arrangement of claim 1, wherein the locking element and the actuating element are configured such that a pivoting movement of the actuating element from the locking position into the release position transfers the locking element into the passive position.

9. The brake arrangement of claim 1, wherein, in the locking position of the actuating element, the actuating element has a second contour which is designed to hold the locking element in the active position.

10. The brake arrangement of claim 1, wherein the actuating element comprises an actuating lever pivotably mounted on the base, wherein the actuating lever comprises at least one lever arm pivotably mounted on the base, and an actuating portion.

11. The brake arrangement of claim 10, wherein the first contour is formed on an insert element, wherein the insert element is inserted into a recess on the lever arm.

12. The brake arrangement of claim 9, wherein the actuating element comprises an actuating lever pivotably mounted on the base, wherein the actuating lever comprises a lever arm pivotably mounted on the base, and an actuating portion; and wherein the second contour is formed on an insert element, wherein the insert element is inserted into a recess on the lever arm.

13. A heel unit for a touring binding, comprising a brake arrangement, comprising:

a base having a fastening arrangement for fastening to one or more of a ski or the touring binding;

a pedal comprising a step surface for a shoe on a side of the pedal facing away from the ski;

at least one brake arm mounted on the base and on the pedal;

at least one first resilient element to preload the brake arrangement into a braking position;

a locking element, wherein the locking element is adjustable between an active position and a passive position and, when in the active position, locks the brake arrangement in a sliding position, wherein the locking element is linearly displaceable along a longitudinal direction of the ski for adjustment between the active position and the passive position; and an actuating element including a first contour, wherein the actuating element is adjustable between a locking position and a release position, wherein the actuating element is mounted on the brake arrangement, so as to pivot about a pivot axis, wherein:

when the actuating element is set into the locking position, the locking element is set into the active position, and when the actuating element is set in the release position, the locking element is set into the passive position and held in the passive position by the first contour, and a pivoting movement of the actuating element about the pivot axis causes a linear movement of the locking element in the longitudinal direction of the ski.

14. The heel unit of claim 13, wherein the heel unit and the actuating element are configured such that, in the release position of the actuating element, a coupling of a shoe to the heel unit is possible and, in the locking position of the actuating element, a coupling of the shoe to the heel unit is not possible.

15. The heel unit of claim 14, wherein the shoe comprises a heel portion of a ski boot.

16. The brake arrangement of claim 1, wherein the shoe comprises a heel portion of a ski boot.

17. The brake arrangement of claim 1, wherein the actuating element is mounted on the base of the brake arrangement.

18. The brake arrangement of claim 5, wherein a pivot axis of the pedal is guided so as to be longitudinally displaced in an elongate hole provided on the base.

19. The brake arrangement of claim 10, wherein the at least one lever arm comprises two lever arms.

* * * * *